US006311878B1

(12) United States Patent
Kimble et al.

(10) Patent No.: US 6,311,878 B1
(45) Date of Patent: Nov. 6, 2001

(54) DISPENSING PACKAGE FOR FLUENT PRODUCTS

(75) Inventors: Bradley J. Kimble, Holland; John W. Safian, Maumee; Robert E. Harman, Perrysburg, all of OH (US)

(73) Assignee: Owens-Brockway Plastics Products Inc., Toledo, OH (US)

( * ) Notice: Subject to any disclaimer, the term of this patent is extended or adjusted under 35 U.S.C. 154(b) by 0 days.

(21) Appl. No.: 09/479,135

(22) Filed: Jan. 7, 2000

(51) Int. Cl.[7] ..... B65D 25/40
(52) U.S. Cl. ..... 222/556; 222/494
(58) Field of Search ..... 222/212, 387, 222/481, 494, 556

(56) References Cited

U.S. PATENT DOCUMENTS

| | | |
|---|---|---|
| Re. 30,861 | 2/1982 | Krawagna . |
| D. 204,511 | 4/1966 | Leeds et al. . |
| D. 223,602 | 5/1972 | Hoffman . |
| D. 224,092 | 7/1972 | Steidley . |
| D. 236,880 | 9/1975 | Sway . |

(List continued on next page.)

FOREIGN PATENT DOCUMENTS

| | | |
|---|---|---|
| 2120079 | 11/1972 | (DE) . |
| 8815614 | 3/1989 | (DE) . |
| 0591601 | 4/1994 | (EP) . |
| 0791542 | 8/1997 | (EP) . |
| 2609000 | 7/1988 | (FR) . |
| 4771 | of 1876 | (GB) . |

OTHER PUBLICATIONS

Photographs labeled "A" through "G" each showing three closure specimens.
Seaquist Closures Publications (2 sides) C–044/5M entitled "Disc Top Dispensing Closures" 1986.

*Primary Examiner*—Allan N. Shoap
*Assistant Examiner*—Melvin A. Cartagena

(57) ABSTRACT

A container and closure package for dispensing a fluent product that includes an integrally molded plastic container and a one-piece molded plastic closure. The closure is secured to the container within a recess in the upper portion of the container so that the closure conforms to the outlines of the container body. The closure has a base with an annular wall and an interior bead that is received by snap fit over an exterior bead on an annular wall surrounding the outlet opening of the container. A pair of laterally opposed aprons depend from the closure base, and have interior beads that are received by snap fit over exterior beads on the container for enhanced retention of the closure on the container. Strengthening webs extend along the recessed portion of the container to the annular wall surrounding the container outlet opening to strengthen the container against buckling during application of the closure. Gussets extend from the closure aprons to the annular wall of the closure base for rigidifying the closure base.

27 Claims, 4 Drawing Sheets

U.S. PATENT DOCUMENTS

| | | |
|---|---|---|
| D. 245,225 | 8/1977 | Lyons . |
| D. 325,164 | 4/1992 | Cann et al. . |
| D. 353,332 | 12/1994 | Behm et al. . |
| 1,033,688 | 7/1912 | Fuchs . |
| 1,033,689 | 7/1912 | Fuchs . |
| 1,102,302 | 7/1914 | Slade . |
| 1,173,546 | 2/1916 | Baron . |
| 1,666,743 | 4/1928 | Klopsteg . |
| 1,861,602 | 6/1932 | Koze . |
| 1,925,926 | 9/1933 | Kunkel . |
| 2,272,867 | 2/1942 | Cobel . |
| 2,312,380 | 3/1943 | Bernhardt . |
| 2,361,958 | 11/1944 | Nyden . |
| 2,391,345 | 12/1945 | Punte . |
| 2,474,678 | 6/1949 | Kitchen . |
| 2,484,148 | 10/1949 | Beatty et al. . |
| 2,574,422 | 11/1951 | Stoos, Jr. et al. . |
| 2,575,106 | 11/1951 | Hermani . |
| 2,694,511 | 11/1954 | Bogeaus et al. . |
| 2,808,183 | 10/1957 | Olson et al. . |
| 2,812,120 | 11/1957 | Beall, Jr. . |
| 2,894,660 | 7/1959 | Gordon . |
| 2,961,133 | 11/1960 | Ankney . |
| 3,078,497 | 2/1963 | Micallef . |
| 3,094,256 | 6/1963 | Ensch . |
| 3,131,824 | 5/1964 | Van Baarn . |
| 3,135,441 | 6/1964 | Wise et al. . |
| 3,157,322 | 11/1964 | Bernhardt . |
| 3,201,011 | 8/1965 | Brocken . |
| 3,252,632 | 5/1966 | Hagenes . |
| 3,300,104 | 1/1967 | Burt . |
| 3,302,835 | 2/1967 | Eckles . |
| 3,303,971 | 2/1967 | Stevens, Jr. . |
| 3,371,827 | 3/1968 | Micallef . |
| 3,377,005 | 4/1968 | Marder . |
| 3,383,019 | 5/1968 | Waterman . |
| 3,400,866 | 9/1968 | Fattori . |
| 3,429,488 | 2/1969 | Micallef . |
| 3,471,066 | 10/1969 | Micallef . |
| 3,484,027 | 12/1969 | Micallef . |
| 3,516,581 | 6/1970 | Micallef . |
| 3,539,075 | 11/1970 | Bautista . |
| 3,542,256 | 11/1970 | Waterman . |
| 3,642,179 | 2/1972 | Micallef . |
| 3,653,546 | 4/1972 | Hazard . |
| 3,675,804 | 7/1972 | Micalief . |
| 3,675,812 | 7/1972 | Foster . |
| 3,702,165 | 11/1972 | Carow et al. . |
| 3,734,359 | 5/1973 | Waterman . |
| 3,771,685 | 11/1973 | Micallef . |
| 3,785,528 | 1/1974 | Mandeltort . |
| 3,847,313 | 11/1974 | Micallef . |
| 3,853,250 | 12/1974 | Alpern . |
| 3,948,422 | 4/1976 | Micallef . |
| 3,957,181 | 5/1976 | Hazard . |
| 3,967,764 | 7/1976 | Hazard . |
| 4,006,836 | 2/1977 | Micallef . |
| 4,015,756 | 4/1977 | Beck . |
| 4,022,352 | 5/1977 | Pehr . |
| 4,158,902 | 6/1979 | Chernack et al. . |
| 4,219,138 | 8/1980 | Hazard . |
| 4,220,248 | 9/1980 | Wilson et al. . |
| 4,291,818 | 9/1981 | Nozawa et al. . |
| 4,343,397 | 8/1982 | Nozawa et al. . |
| 4,358,032 | 11/1982 | Libit . |
| 4,371,095 | 2/1983 | Montgomery et al. . |
| 4,377,247 | 3/1983 | Hazard et al. . |
| 4,399,928 | 8/1983 | Klingler . |
| 4,441,637 | 4/1984 | Libit . |
| 4,487,342 | 12/1984 | Shy . |
| 4,579,260 | 4/1986 | Young et al. . |
| 4,598,839 | 7/1986 | Dombroski et al. . |
| 4,625,898 | 12/1986 | Hazard . |
| 4,645,086 | 2/1987 | Rosenthal . |
| 4,678,107 | 7/1987 | Ennis, III . |
| 4,732,303 | 3/1988 | Wang . |
| 4,776,501 | 10/1988 | Ostrowsky . |
| 4,793,502 | 12/1988 | Beck . |
| 4,815,616 | 3/1989 | Silvenis . |
| 4,838,460 | 6/1989 | Moore et al. . |
| 4,848,601 | 7/1989 | Reil . |
| 4,861,541 | 8/1989 | Kaminski et al. . |
| 4,911,635 | 3/1990 | Kaminski et al. . |
| 4,962,869 | 10/1990 | Gross et al. . |
| 4,978,035 | 12/1990 | Morane et al. . |
| 4,982,882 | 1/1991 | Gueret . |
| 5,022,566 | 6/1991 | Song et al. . |
| 5,022,567 | 6/1991 | Frazer . |
| 5,052,595 | 10/1991 | Mon . |
| 5,054,662 | 10/1991 | Santagiuliana . |
| 5,058,775 | 10/1991 | Gross et al. . |
| 5,065,912 | 11/1991 | Rosenthall . |
| 5,105,989 | 4/1992 | Gutkowski . |
| 5,123,561 | 6/1992 | Gross . |
| 5,147,072 | 9/1992 | Dirksing . |
| 5,192,005 | 3/1993 | Zimmerman . |
| 5,201,440 | 4/1993 | Gross . |
| 5,213,235 | 5/1993 | Miranda . |
| 5,236,107 | 8/1993 | Spaanstra, Sr. . |
| 5,242,079 | 9/1993 | Stephens et al. . |
| 5,259,538 | 11/1993 | Tardif . |
| 5,279,451 | 1/1994 | Mueller et al. . |
| 5,284,264 | 2/1994 | Gross . |
| 5,314,093 | 5/1994 | Gross et al. . |
| 5,341,960 | 8/1994 | Lay . |
| 5,346,100 | 9/1994 | Lay . |
| 5,370,277 | 12/1994 | Wallis . |
| 5,370,284 | 12/1994 | Dirksing . |
| 5,482,172 | 1/1996 | Braddock . |
| 5,544,790 | 8/1996 | Lu . |
| 5,918,777 * | 7/1999 | Flak ..... 222/212 |

* cited by examiner

DISPENSING PACKAGE FOR FLUENT PRODUCTS

The present invention is directed to dispensing packages for fluent products such as viscous liquid products, and more particularly to a package that includes an integrally molded plastic container and a closure with dispensing valve integrated into the contours of the container.

BACKGROUND AND SUMMARY OF THE INVENTION

U.S. Pat. No. 5,918,777, assigned to the assignee of the present application, discloses a dispensing package and method of manufacture in which the package includes an integrally molded plastic container having a recessed surface with dispensing opening in the upper portion of the container, and a closure secured within the recess and having a valve element for selectively closing and opening the container outlet to dispense product. In some embodiments disclosed in the noted patent, the closure is of integrally molded plastic construction, having a base secured over the container dispensing opening within the recessed portion of the container, and a valve element coupled to the base by an integral hinge for selectively opening and closing the package.

Although the dispensing package and method of manufacture disclosed in the noted patent address and overcome problems theretofore extant in the art, further improvements are desirable. It is an object of the present invention to provide a container and closure package of the type disclosed in the above-noted patent that improves securement of the closure on the container to help prevent inadvertent disassembly of the closure from the container during handling or opening of the package or during dispensing of product from the package. Another object of the present invention is to provide a container and closure package of the type illustrated in the noted patent that is characterized by increased strength in the container around the dispensing opening so as to prevent distortion or collapse of the container due to top load forces during removal of moil flash from the container as molded or securement of the closure on the container. A further object of the invention is to provide a container and closure package of the type illustrated in the above-noted patent in which the closure exhibits increased strength and reduced susceptibility to process variations during manufacture. Yet another object of the present invention is to provide a container for use in such a package, a closure for use in such a package, and a method of forming such a package.

A container and closure package for dispensing a fluent product in accordance with one aspect of the present invention includes an integrally molded plastic container having a flexible body and a recessed portion in the upper exterior of the container body. The recessed portion of the container has a base wall, at least one sidewall extending upwardly from the base wall, an outlet opening in the base wall, and laterally opposed recessed side portions extending from the base wall and being recessed inwardly from the sidewall portion of the container body. A closure is secured to the container in the recessed portion of the container in communication with the outlet opening. The closure has a valve movable from a closed to an open position to dispense product from the interior of the container, and laterally opposed aprons that extend along the recessed side portions of the recessed portion of the container. In the preferred embodiment in accordance with this aspect of the invention, the recessed side portions of the container include respective exterior retention beads, and the closure aprons include respective interior retention beads that are secured over the exterior retention beads on the container for holding the closure on the container. The outlet opening in the recessed portion of the container is surrounded by an axial wall that has an exterior retention bead, and the closure has a complementary annular wall with an interior retention bead that is secured over the exterior retention bead on the outlet opening annular wall. Thus, in this preferred embodiment, the beads on the annular walls surrounding the container outlet opening, and the beads on the closure aprons and container sidewall portions, cooperate to retain the closure on the container during handling of the package, during opening of the package during use, and during dispensing of fluent product from the package.

A container and closure package for dispensing fluent product in accordance with a second aspect of the present invention, which may be implemented separately from or more preferably in combination with other aspects of the invention, includes an integrally molded plastic container having a flexible body and a recessed portion in the upper exterior of the container body. The recessed portion has a base wall, at least one sidewall extending upwardly from the base wall, an outlet opening in the base wall surrounded by an annular wall, and a raised web extending along the base wall from the at least one sidewall to the annular wall that surrounds the outlet opening. A closure is secured to the container in the recessed portion of the container in communication with the outlet opening, and includes a valve movable from a closed position to an open position to dispense product. In the preferred embodiment of the invention, the recessed portion of the container is defined in part by a pair of opposed sidewalls that extend upwardly from the base wall, and a raised web extends from each sidewall to the annular wall that surrounds the dispensing opening. These raised webs increase the strength of the container around the annular wall that surrounds the outlet opening to prevent distortion and buckling during application of top load forces during removal of moil flash following molding of the container, and during application of the closure to the container.

In accordance with a third aspect of the present invention, which again may be implemented separately from or more preferably in combination with other aspects of the invention, at least one gusset or rib extends from each closure apron radially inwardly to the closure annular wall that is received over the annular wall surrounding the container outlet opening. In the preferred embodiment of the invention, a pair of spaced gussets or ribs extend along the underside of the closure from each closure apron to the opposing surface of the closure annular wall. These gussets increase the strength of the closure base against buckling or distortion during application to the container and during use, and help to reduce variations in closure operating characteristics due to tolerance variations during the manufacturing process.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
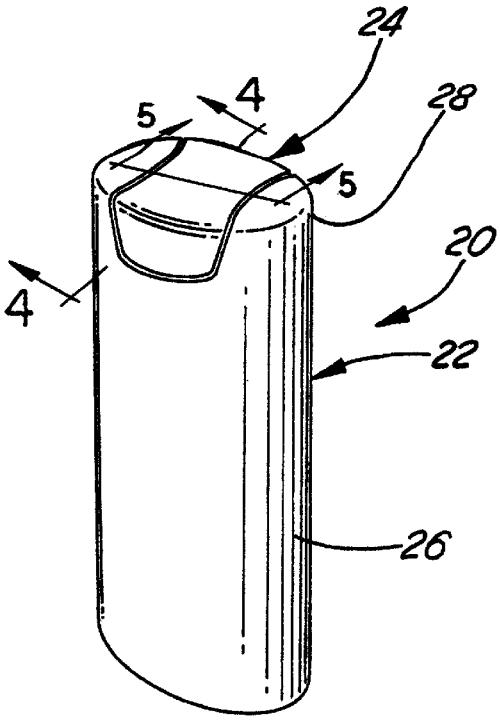
FIG. 1 is a perspective view of a container and closure package in accordance with one presently preferred embodiment of the invention.
Figure 2:
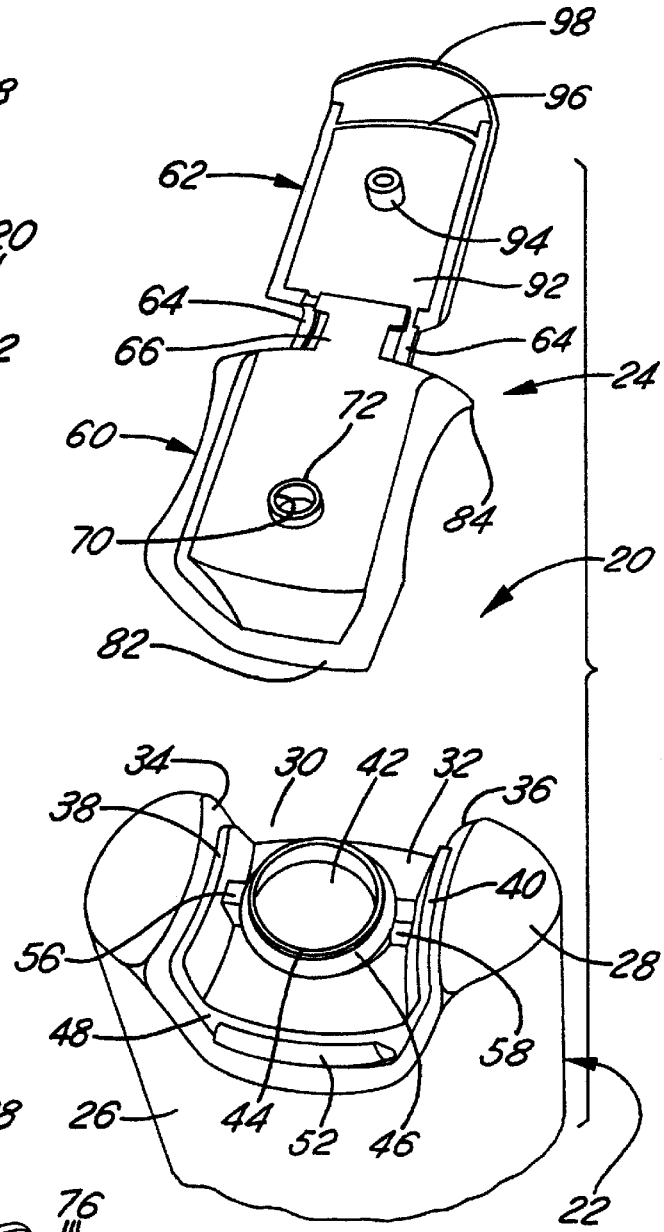
FIG. 2 is a fragmentary exploded perspective view of the container and closure package illustrated in FIG. 1.
Figure 3:
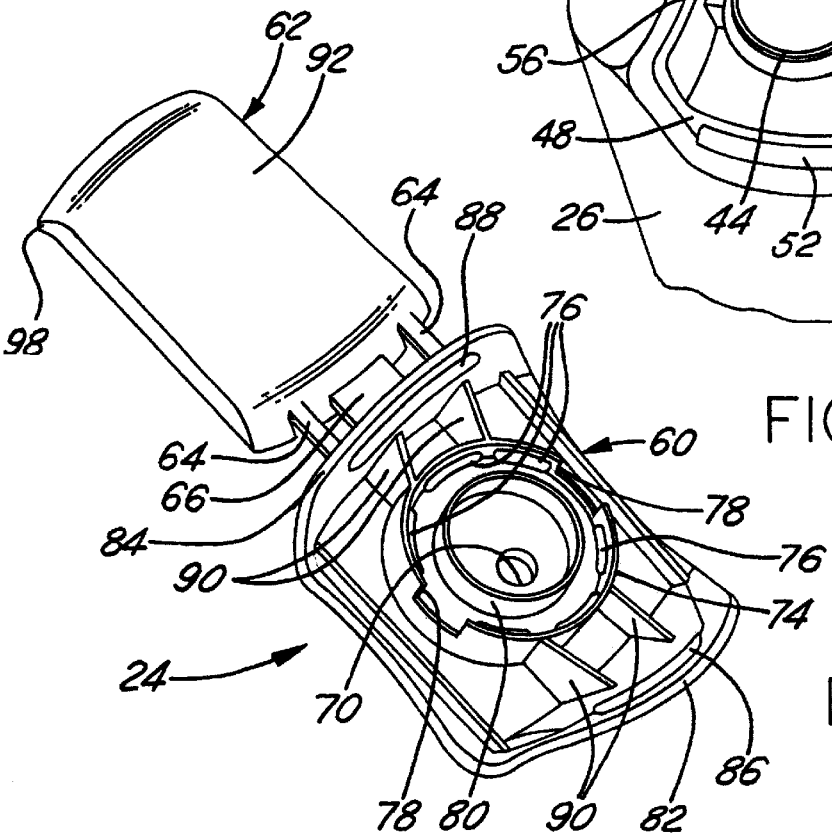
FIG. 3 is a perspective view of the underside of the closure illustrated in FIG. 2.

The disclosure of above-noted U.S. Pat. No. 5,918,777 is incorporated herein by reference.

FIGS. 1–2 and 4–5 illustrate a container and closure package 20 for dispensing a fluent product in accordance with one presently preferred embodiment of the invention. Package 20 includes a container 22 and a dispensing closure 24. Container 22 is of integrally molded plastic construction, and includes a sidewall portion 26, an upper exterior portion 28 and a recessed portion 30 inwardly recessed with respect to the upper exterior portion. Recessed portion 30 is defined by an outwardly convex base wall 32, and a pair of opposed outwardly convex sidewalls 34, 36 that extend upwardly at an outward angle from base wall 32. Each sidewall 34, 36 has an associated shoulder 38, 40 against which closure 24 rests. A circular outlet opening 42 is centrally disposed in base wall 32, and is surrounded by an annular wall 44 that projects upwardly from base wall 32. An exterior bead 46 surrounds annular wall 44.

Figure 5:
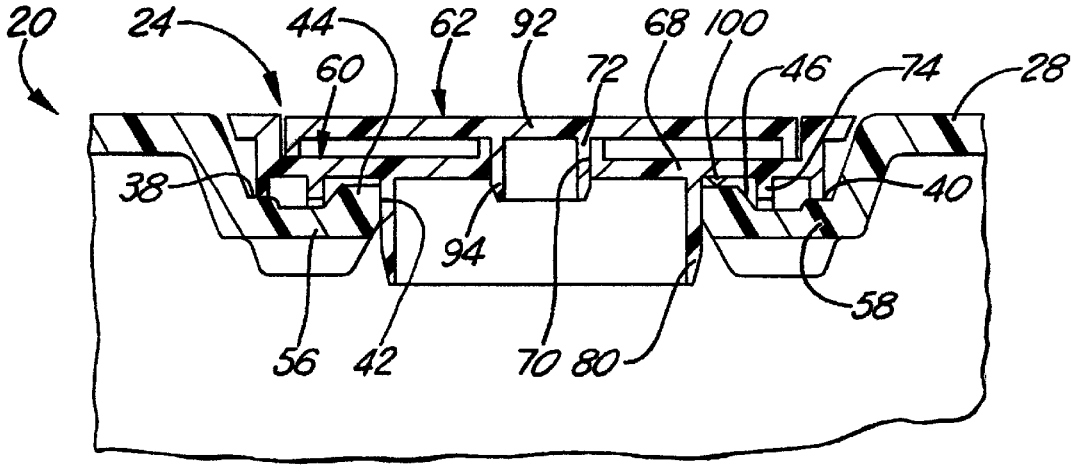
Figure 6:
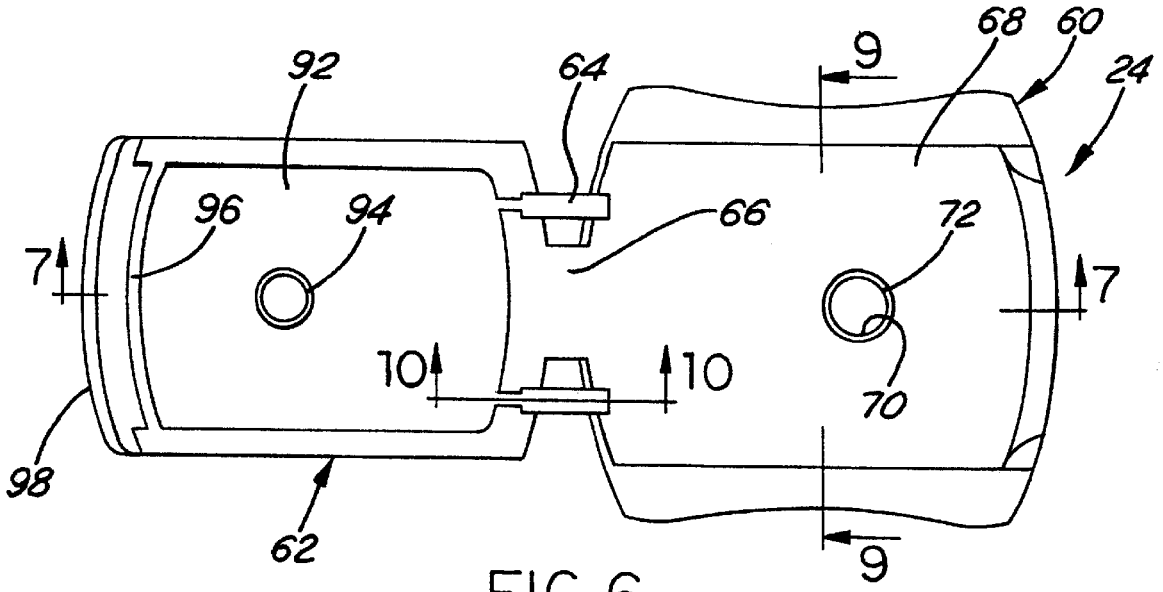
FIG. 6 is a top plan view of the closure illustrated in FIGS. 1–5.
Figure 7:
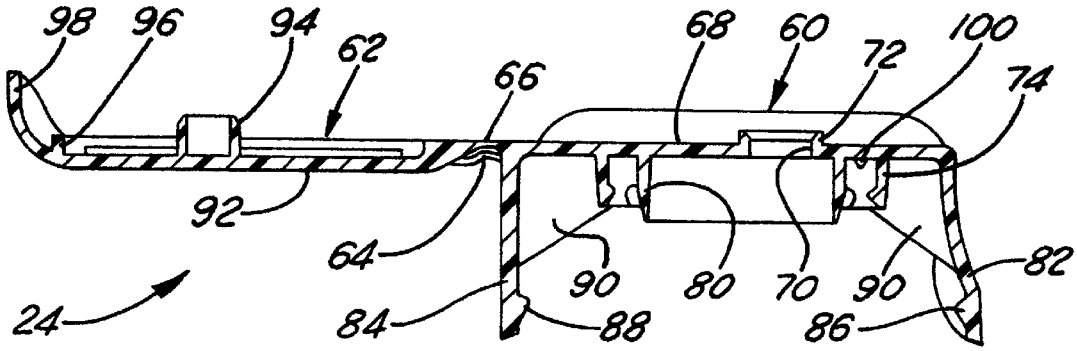
FIG. 7 is a sectional view taken substantially along the line 7—7 in FIG. 6.
Figure 8:
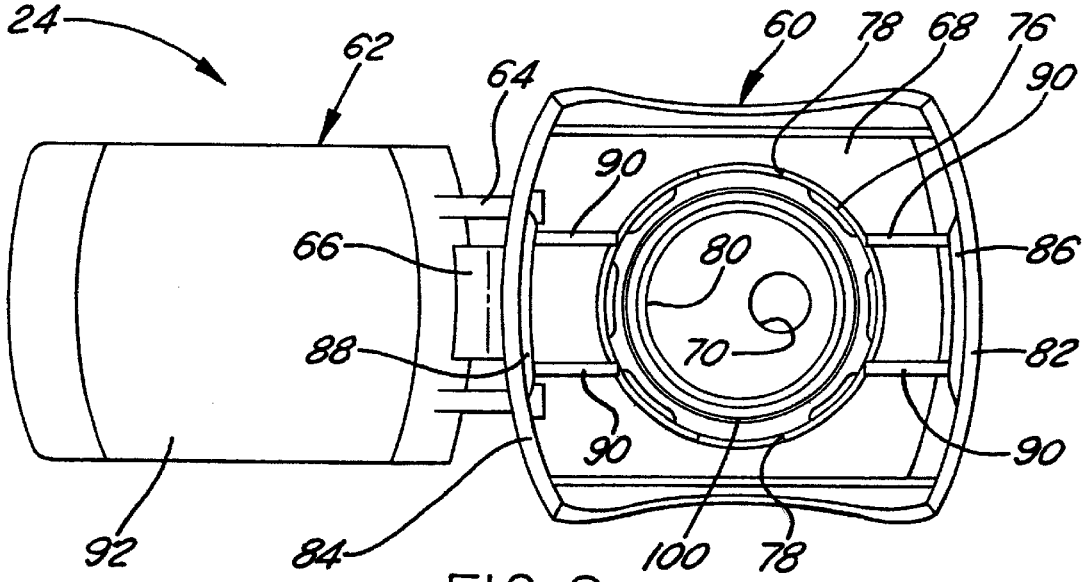
FIG. 8 is a bottom plan view of the closure illustrated in FIGS. 6–7.
Figure 9:
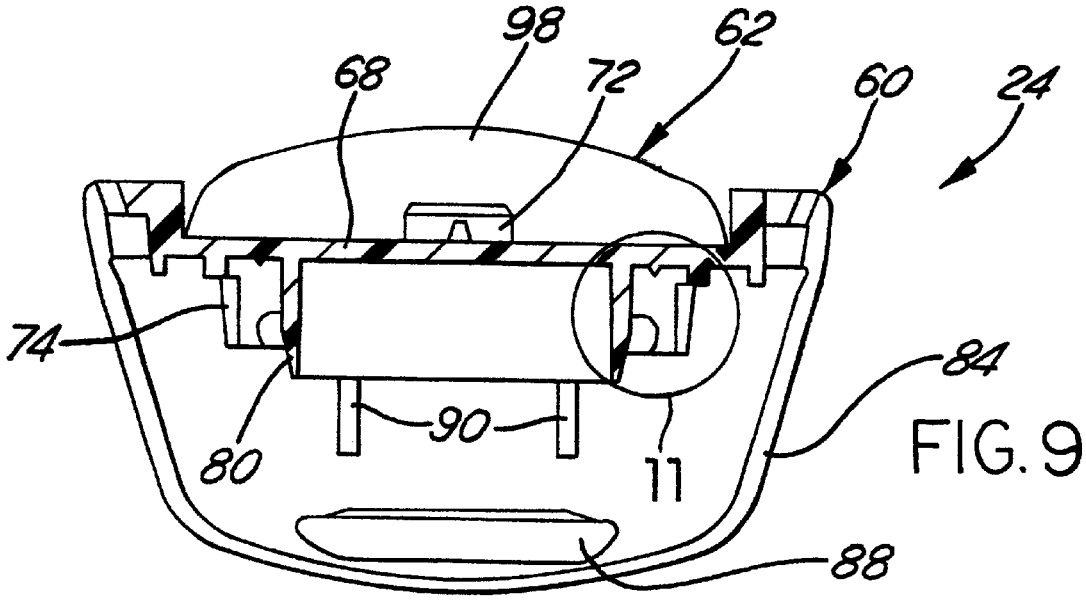
FIGS. 9 and 10 are sectional views taken substantially along the respective lines 9—9 and 10—10 in FIG. 6.
Figure 10:
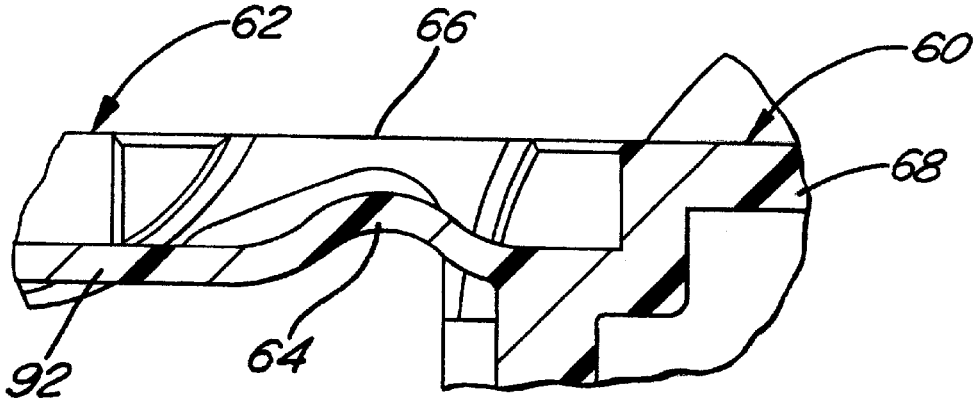
Figure 11:
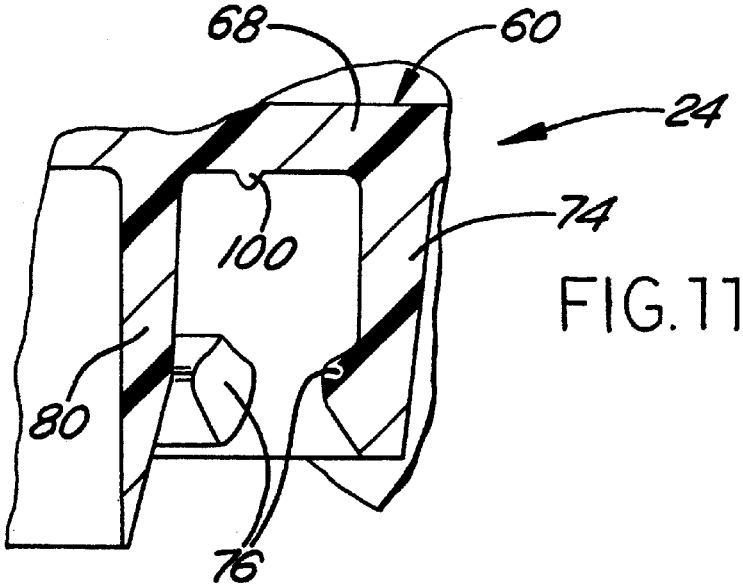
FIG. 11 is a fragmentary sectional view of the portion of FIG. 9 within the circle 11.

A pair of laterally opposed recessed side portions 48, 50 extend from base wall 32 and are recessed inwardly with respect to the sidewall of container body portion 26. Thus, recessed portion 30 is recessed both with respect to the axial end portion 28 of container 22 and with respect to the sidewall portion of container 22. An exterior bead 52, 54 extends laterally along respective associated recessed side portions 48, 50. Beads 52, 54 preferably are linear and disposed in a common plane parallel to but spaced from the upper edge of outlet annular wall 44. A rectangular web 56, 58 extends radially inwardly from respective associated sidewalls 34, 36 to the opposing surface of annular wall 44 that surrounds outlet opening 42. As best seen in FIG. 5, webs 56, 58 terminate at annular wall 44 beneath the level of bead 46, with the lower edge of bead 46 merging into webs 56, 58. Webs 56, 58 have a hollow underside and are aligned with each other diametrically of wall 44. Container 22 is preferably blow molded of integral plastic composition such as high density polyethylene, for example.

Closure 24, which may be injection molded of polypropylene, for example, includes a base 60 and a closure valve 62 integrally coupled to base 60 by hinge elements 64, 66. Closure base 60 includes a flat base wall 68 in which an outlet opening 70 is surrounded by an upstanding annular wall 72. A first annular wall 74 depends from closure base wall 68, and has a segmented annular bead 76 formed on the interior surface thereof. Interruptions 78 in annular wall 74 fit over webs 56, 58 of container 22 in assembly of closure 24 to container 22, as will be described. A circumferentially continuous second annular wall 80 depends from closure base wall 68 radially inwardly from annular wall 74 for sliding plug-sealing engagement with the inside diameter of container outlet opening 42. A pair of laterally opposed aprons 82, 84 depend from opposed edges of closure base wall 68. Each apron 82, 84 is inwardly concave and has an associated interior bead 86, 88, which are coplanar with each other and spaced from base wall 68 such that beads 86, 88 are received by snap fit over container beads 52, 54 to secure closure 24 on container 22.

Figure 4:
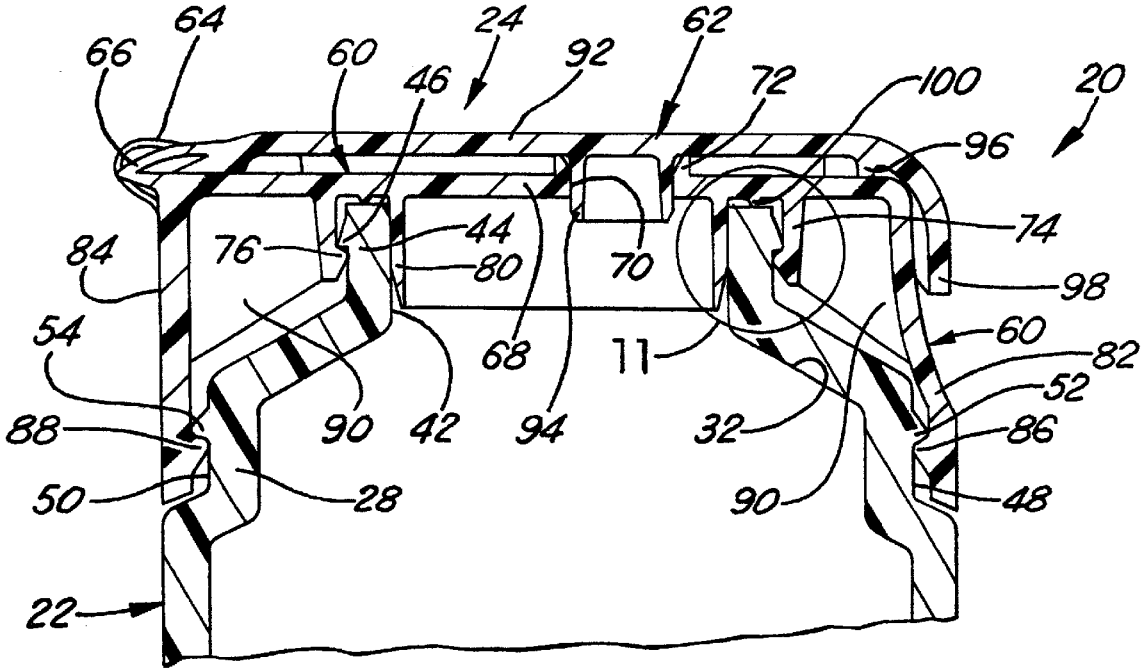
FIGS. 4 and 5 are fragmentary sectional views taken substantially along the lines 4—4 and 5—5 in FIG. 1.

A pair of spaced parallel gussets or ribs 90 extend radially inwardly along the underside of base wall 68 from each apron 82, 84 to the opposing surface of annular wall 74. As best seen in FIG. 4, the edges of gussets 90 spaced from base wall 68 are angulated to follow the contour of container recess base wall 32. Valve 62 has a base wall 92 from which an annular wall 94 extends for plug-sealing engagement within annular wall 72 that defines and surrounds closure outlet opening 70. A rib 96 on the underside of base wall 92 spaces base wall 92 from base wall 68 in the closed position of valve 62, as best seen in FIG. 4. Base wall 92 terminates in a downwardly projecting lip 98 that extends along apron 82 for grasping by a user to open closure valve 62 with respect to closure base 60. An annular bead 100 depends from base wall 68 between annular walls 74, 80 for sealing engagement with the upper edge surface of outlet wall 84 of container 22, as best seen in FIGS. 4 and 5.

Container 22 and closure 24 are formed separately in suitable molding operations, container 22 is trimmed as required, and container 22 and closure 24 are then secured to each other after the package is filled with product. Closure 24 is assembled over wall 44 of container 22 within recessed portion 30 in the upper portion of the container. Segmented bead 76 on annular wall 74 of closure 24 is received by snap fit over bead 46 on annular container outlet wall 44. Interruptions 78 in closure annular wall 74 fit over webs 56, 58 of container 22 without interfering with the webs. Closure aprons 82, 84 extend downwardly through recessed side portions 48, 50 of container 22, and apron beads 86, 88 snap over beads 52, 54 on container 22. The combination of beads 44, 76 surrounding the container outlet opening and beads 52, 54, 86, 88 at the closure aprons improves retention of closure 24 on container 22 during handling and opening of the container by an operator, and during dispensing of product from within the container. Webs 56, 58 strengthen the upper portion of the container against buckling or collapse as closure 24 is applied to container 22. The webs also make removal of the moil (molded with the container) easier because part of the flash can be left in the container. The moil can thus be removed by hand, or by simplified deflashing equipment. Webs 56, 58 also form interior channels for flow of product to outlet opening 42 from the elevated shoulders at each side of recessed portion 30. Gussets 90 extending between closure annular wall 74 and closure aprons 82, 84 improve rigidity of closure base 60 and help hold aprons 82, 84 against the opposing portions of the container.

There have thus been disclosed a container and closure package, a container, a closure and methods of making the same, which fully satisfy all of the objects and aims previously set forth. Modifications and variations will readily suggest themselves to persons of ordinary skill in the art. The invention is intended to embrace all such modifications and variations as fall within the spirit and broad scope of the appended claims.

What is claimed is:

1. A container and closure package for dispensing a fluent product, which comprises:

an integrally molded plastic container having a flexible body with a body sidewall portion, an upper exterior portion and a recessed portion inwardly recessed with respect to said upper exterior portion, said recessed portion having a base wall, at least one sidewall extending upwardly from said base wall, an outlet opening in said base wall, and laterally opposed recessed side portions extending from said base wall and being recessed inwardly from said body sidewall portion, said recessed side portions including respective exterior retention beads, and a closure secured to said container in said recessed portion of said container in communication with said outlet opening, said closure having a valve moveable from a closed to an open position for dispensing product, and laterally opposed aprons that extend within said recessed side portions of said recessed portion of said container, said aprons including respective interior beads received over said exterior retention beads for holding said closure on said container.

2. The package set forth in claim 1 wherein said outlet opening in said base wall is surrounded by an annular wall and an exterior bead on said annular wall, and wherein said closure includes an annular wall with an interior bead received over said exterior bead for holding said closure on said container.

3. The package set forth in claim 2 wherein said recessed portion of said container further includes a raised web extending along said base wall from said at least one sidewall to said annular wall surrounding said outlet opening.

4. The package set forth in claim 3 wherein said annular wall on said closure has interruptions to fit over said raised web.

5. The package set forth in claim 3 wherein said recessed portion of said container includes two of said sidewalls on opposite sides of said recessed portion and two of said raised webs extending along said base wall from said two sidewalls to said annular wall surrounding said outlet opening.

6. The package set forth in claim 5 wherein said annular wall on said closure has interruptions to fit over said raised webs.

7. The package set forth in claim 2 wherein said closure further includes at least one strengthening gusset interiorly extending from each said apron to said annular wall on said closure.

8. The package set forth in claim 7 wherein said closure includes a pair of spaced parallel strengthening gussets interiorly extending from each said apron to said annular wall on said closure.

9. The package set forth in claim 1 wherein said closure is of integrally molded plastic construction, including a base secured to said container and said valve hinged to said base.

10. A container and closure package for dispensing a fluent product, which comprises:

an integrally molded plastic container having a flexible body with a body sidewall portion, an upper exterior portion and a recessed portion inwardly recessed with respect to said upper exterior portion, said recessed portion having a base wall, at least one sidewall extending upwardly from said base wall, an outlet opening in said base wall surrounded by an annular wall, and a raised web extending along said base wall from said at least one sidewall to said annular wall surrounding said outlet opening, and a closure secured to said container in said recessed portion of said container in communication with said outlet opening, said closure having a valve movable from a closed to an open position for dispensing product.

11. The package set forth in claim 10 wherein said recessed portion of said container includes two said sidewalls on opposite sides of said recessed portion and two of said raised webs extending along said base wall from said two sidewalls to said annular wall surrounding said outlet opening.

12. The package set forth in claim 10 wherein said annular wall in said recessed portion includes an exterior bead, wherein said closure includes an annular wall with an interior bead received over said exterior bead for holding said closure on said container, and wherein said annular wall on said closure has interruptions to fit over said raised web.

13. The package set forth in claim 10 wherein said recessed portion of said container includes laterally opposed recessed side portions extending from said base wall and being recessed inwardly from said body sidewall portion, and wherein said closure includes laterally opposed aprons that extend within said side portions of said recessed portion of said container.

14. The package set forth in claim 13 wherein said recessed side portions include respective exterior retention beads, and wherein said aprons of said closure include respective interior beads received over said exterior retention beads for holding said closure on said container.

15. The package set forth in claim 14 wherein said outlet opening in said base wall is surrounded by an annular wall and an exterior bead on said annular wall, and wherein said closure includes an annular wall with an interior bead received over said exterior bead for holding said closure on said container.

16. The package set forth in claim 15 wherein said closure further includes at least one strengthening gusset interiorly extending from each said apron to said annular wall on said closure.

17. The package set forth in claim 16 wherein said closure includes a pair of spaced parallel strengthening gussets interiorly extending from each said apron to said annular wall on said closure.

18. The package set forth in claim 11 wherein said closure is of integrally molded plastic construction, including a base secured to said container and said valve hinged to said base.

19. An integrally molded plastic container having a flexible body with a body sidewall portion, an upper exterior portion and a recessed portion inwardly recessed with respect to said upper exterior portion, said recessed portion having a base wall, at least one sidewall extending upwardly from said base wall, an outlet opening in said base wall, and laterally opposed recessed side portions extending from said base wall and being recessed inwardly from said body sidewall portion, said recessed side portions including respective exterior beads for retaining a closure on the container.

20. The container set forth in claim 19 wherein said outlet opening in said base wall is surrounded by an annular wall and an exterior bead on said annular wall, and a raised web extending along said base wall from said at least one sidewall to said annular wall surrounding said outlet.

21. The container set forth in claim 20 wherein said recessed portion of said container includes two of said sidewalls on opposite sides of said recessed portion and two of said raised webs extending along said base wall from said two sidewalls to said annular wall surrounding said outlet opening.

22. An integrally molded plastic container having a flexible body with a body sidewall portion, an upper exterior portion and a recessed portion inwardly recessed with respect to said upper exterior portion, said recessed portion having a base wall, at least one sidewall extending upwardly from said base wall, an outlet opening in said base wall surrounded by an annular wall, and a raised web extending along said base wall from said at least one sidewall to said annular wall surrounding said outlet opening.

23. The container set forth in claim 22 wherein said recessed portion of said container includes two said sidewalls on opposite sides of said recessed portion and two of said raised webs extending along said base wall from said two sidewalls to said annular wall surrounding said outlet opening.

24. The container set forth in claim 22 wherein said annular wall in said recessed portion includes an exterior bead for holding a closure on said container.

25. The container set forth in claim 22 wherein said recessed portion of said container includes laterally opposed recessed side portions extending from said base wall and being recessed inwardly from said body sidewall portion.

26. The container set forth in claim 25 wherein said recessed side portions include respective exterior beads for retaining a closure on the container.

27. The container set forth in claim 26 wherein said outlet opening in said base wall is surrounded by an annular wall and an exterior bead on said annular wall, and a raised web extends along said base wall from said at least one sidewall to said annular wall surrounding said outlet opening.

* * * * *